US008269405B1

(12) United States Patent
Wang

(10) Patent No.: US 8,269,405 B1
(45) Date of Patent: Sep. 18, 2012

(54) NEUTRAL ELECTRODE SPARK PLUG

(76) Inventor: Calvin Wang, City of Industry, CA (US)

( * ) Notice: Subject to any disclaimer, the term of this patent is extended or adjusted under 35 U.S.C. 154(b) by 0 days.

(21) Appl. No.: 13/135,214

(22) Filed: Jun. 29, 2011

(51) Int. Cl.
*H01T 13/20* (2006.01)

(52) U.S. Cl. ..... 313/141; 313/123

(58) Field of Classification Search ..... 313/141, 313/123
See application file for complete search history.

(56) References Cited

U.S. PATENT DOCUMENTS

| | | | | |
|---|---|---|---|---|
| 1,125,097 | A * | 1/1915 | Hilliker et al. | 313/123 |
| 1,505,373 | A * | 8/1924 | Carpenter | 313/123 |
| 1,505,817 | A * | 8/1924 | Swanson | 313/123 |
| 1,660,635 | A * | 2/1928 | Thompson | 313/123 |
| 2,136,206 | A | 11/1937 | Dukelow | |
| 2,208,059 | A * | 7/1940 | Stahr | 313/123 |
| 3,970,885 | A * | 7/1976 | Kasima | 313/141 |
| 4,931,686 | A | 6/1990 | Oakley | |
| 5,189,333 | A | 2/1993 | Kagawa et al. | |
| 5,821,676 | A | 10/1998 | Atchinson, II et al. | |
| 6,095,124 | A * | 8/2000 | Matsubara et al. | 123/594 |
| 6,750,597 | B1 * | 6/2004 | Sakura | 313/141 |
| 7,230,370 | B2 | 6/2007 | Kato | |
| 7,812,509 | B2 | 10/2010 | Tanaka et al. | |
| 7,936,117 | B2 | 5/2011 | Huang | |
| 7,952,263 | B1 | 5/2011 | Ireland | |
| 2005/0194877 | A1 * | 9/2005 | Horn et al. | 313/141 |
| 2006/0028108 | A1 * | 2/2006 | Okabe et al. | 313/143 |
| 2009/0096345 | A1 * | 4/2009 | Posey | 313/141 |
| 2011/0198982 | A1 * | 8/2011 | Suzuki et al. | 313/141 |

FOREIGN PATENT DOCUMENTS

WO WO 2010053099 A1 * 5/2010

* cited by examiner

*Primary Examiner* — Mariceli Santiago
*Assistant Examiner* — Glenn Zimmerman
(74) *Attorney, Agent, or Firm* — Albert O. Cota

(57) ABSTRACT

A neutral electrode spark plug (10) consisting of a cylindrical metallic shell (20) having a tubular ceramic insulator (22), including an insulator tip (28) enclosed therein, and a central electrode (30) surrounded by the ceramic insulator (22). The central electrode (30) has a firing tip (36) extending from the insulator tip (28). A neutral electrode (38) extends from the insulator tip (28) providing a first spark gap that is separated from the central electrode (30). A side ground electrode (40) is attached to the metallic shell (20) and is laterally aligned with the central electrode (30) and the neutral electrode (38). The ground electrode (40) provides a second spark gap that is separated from the neutral insulator (38) and a third spark gap formed with the ground electrode (40) a distance away from the insulator tip.

16 Claims, 1 Drawing Sheet

NEUTRAL ELECTRODE SPARK PLUG

TECHNICAL FIELD

The invention generally pertains to spark plugs for internal combustion engines, and more particularly to a spark plug having a neutral electrode that is located between a central and a ground electrode.

BACKGROUND ART

Previously, many types of multi-gap spark plugs have been used to provide an effective means for igniting a gaseous mixture of fuel and air within the chamber of an internal combustion engine. The ignition utilizes a high-voltage electric current to create a spark that facilitates combustion that generates the power to drive the cylinders of the internal combustion engine.

A search of the prior art did not disclose any patents that possess the novelty of the instant invention. However, the following U.S. patents are considered related:

| Pat. No. | Inventor | Issued |
|---|---|---|
| 2,136,206 | Dukelow | Nov. 8, 1937 |
| 4,931,686 | Oakley | Jun. 5, 1990 |
| 5,189,333 | Kagawa et al. | Feb. 23, 1993 |
| 5,821,676 | Atchinson, II et al. | Oct. 13, 1998 |
| 7,230,370 B2 | Kato | Jun. 12, 2007 |
| 7,812,509 B2 | Tanaka et al. | Oct. 12, 2010 |
| 7,936,117 B2 | Huang | May 3, 2011 |

Dukelow in U.S. Pat. No. 2,136,206 teaches a spark plug for an internal combustion engine having an intermediate electrode which is insulated from a shell and a central electrode to provide two spark gaps. Thereby resulting in an operation that is much more efficient than is provided with a spark plug having a single spark.

U.S. Pat. No. 4,931,686 issued to Oakley is for a metal spark plug shell with an L-shaped copper core side electrode secured in an axially extended slot on the metal shell. The side electrode includes an attachment end having a portion with an outer side that is threaded contiguous with the metal shell and another portion adjacent to the end of the shell with a recessed outer side that is unthreaded so as to permit spark plug gapping without breakage of the side electrode. The patent includes a heat-resistant sheath that is located around the inner side of the copper core and that typically spot welded to the shell.

Kagawa et al. in U.S. Pat. No. 5,189,333 discloses a multi-gap spark plug having a metallic shell into which a tubular ceramic insulator is enclosed. A center electrode is enclosed in the insulator together with a plurality of L-shaped outer electrodes. The electrodes have a vertical piece and a lateral piece which depend from the front end of the shell surrounding the insulator. The lateral piece has an inner surface parallel with a front end of the insulator. The distance between the insulator and the outer electrode is from 0.3 mm to 1.2 mm.

Atchinson, II et al. in U.S. Pat. No. 5,821,676 teaches a spark plug which includes a center electrode having a tapered portion with a plurality of ridges formed thereon. The spark plug includes a tapered ground electrode positioned over the center electrode. The tapered center and ground electrodes allow for a spark to propagate from the spark plug to the combustion chamber.

U.S. Pat. No. 7,230,370 issued to Kato is for a spark plug having an insulator, a center electrode and a metal shell surrounding the insulator. A first electrode is grounded into the shell and a metal tip is joined to an inner side face of an end portion opposite the face of the center electrode which permits a first discharge gap. The second ground electrode is bonded to the shell allowing a second discharge gap.

U.S. Pat. No. 7,812,509 issued to Tanaka et al. discloses a spark plug with a body, a center electrode, a ground electrode and injection control side poles. The tip of the ground electrode and the tip of the ejection control side poles are positioned in the same plane perpendicular to the axis of the spark plug. The ground electrode and the injection control side poles are arranged at regular intervals around the center electrode.

For background purposes and as indicative of the art to which the invention is related reference may be made to the remaining U.S. Pat. Nos. 7,952,263 issued to Ireland and 7,936,117 issued to Huang.

DISCLOSURE OF THE INVENTION

Spark plugs have been known to exist as early as 1860 and were patented in the United States by Nicola Tesla in 1898. Since then, spark plugs have experienced substantial improvements in an attempt to provide better ignition, longer life, and reliable operation. Such improvements include the use of two, three or even four equally spaced ground electrodes surrounding a central electrode.

Recessed central electrodes have also been developed utilizing single or multiple V-shaped notches located on the tip of the ground electrode or the central electrode. The V-shaped notches provide a longer life when the spark gap widens during an electrical discharge, permitting the spark to move closer to another spot when the electrical discharge surges across the spark gap.

In its basic design configuration the inventive neutral electrode spark plug for an internal combustion engine is comprised of:

A. A metallic shell having an insulator enclosed therein,

B. A central electrode located within the ceramic insulator,

C. A neutral electrode extending from the ceramic insulator and having a first gap from the central electrode, and D. A side ground electrode that is attached to the metallic shell, with the ground electrode having a second gap that is separated from the neutral insulator.

In view of the above disclosure, the primary object of the invention is to improve the operation of a spark plug by providing two separate spark paths utilizing electrodes having sharp edges. The use of sharp-edged electrodes decreases the voltage across the spark gap which in-turn provides a constant and stable ignition. The invention features a neutral electrode that is angled into the central electrode to provide a first spark gap; a second spark gap is created between the neutral electrode and the ground electrode.

An important object of the invention is that the addition of a neutral electrode is easily accomplished by insertion into the ceramic insulator which requires only a small modification in the basic tooling. The manufacturing process is little affected, thereby allowing the improvement to be realized by the user with little expense.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
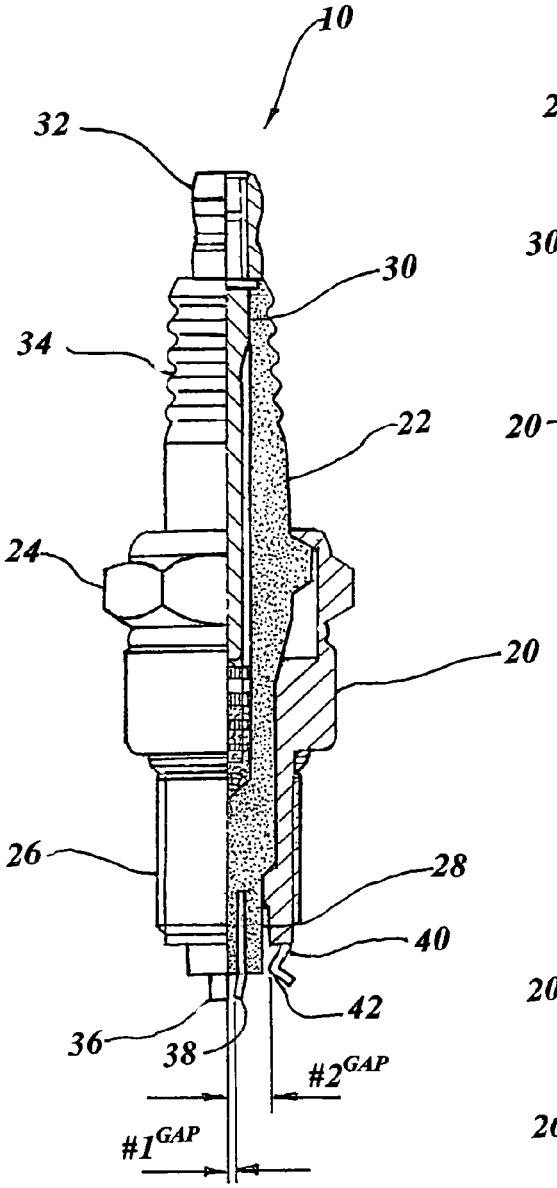
FIG. 1 is a front view of the neutral electrode spark plug in the preferred embodiment, with one side cut away on the centerline to illustrate the internal composition.
Figure 2:
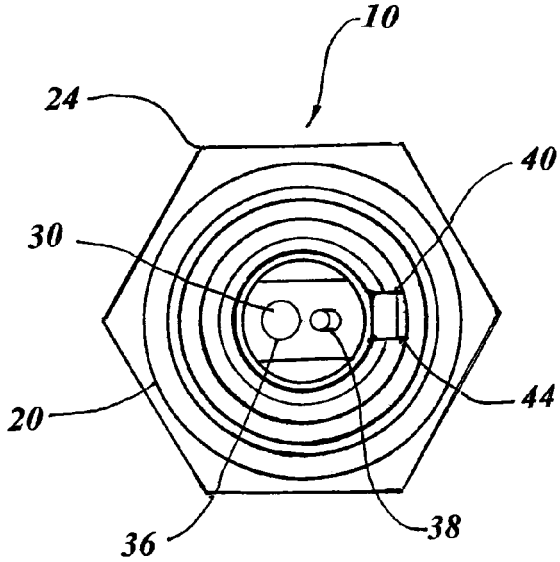
FIG. 2 is an enlarged bottom view of the neutral electrode spark plug in the preferred embodiment.
Figure 3:
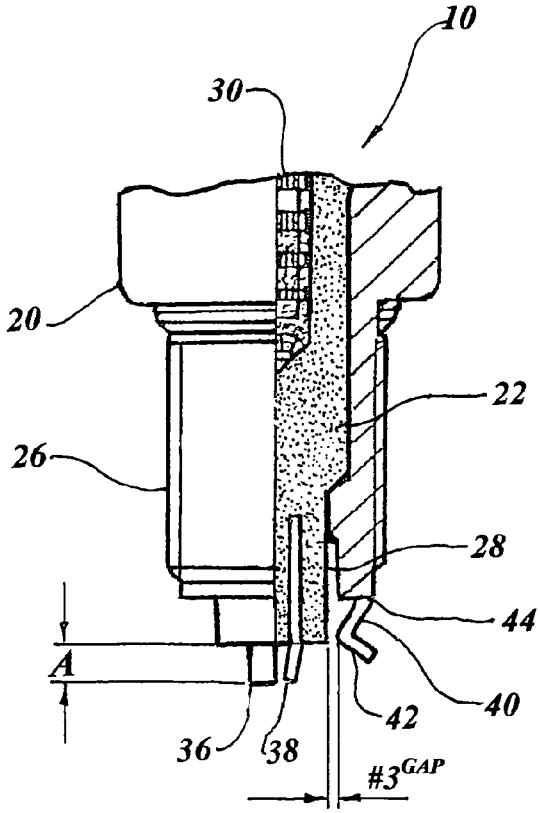
FIG. 3 is an enlarged view of the lower portion of the neutral electrode spark plug in the preferred embodiment.

The best mode for carrying out the invention is presented in terms that disclose a preferred embodiment of a neutral electrode spark plug 10 for an internal combustion engine. The preferred embodiment of the neutral electrode spark plug 10, as shown in FIGS. 1 through 3, is comprised of a cylindrical metallic shell 20 having a tubular ceramic insulator 22 enclosed within. The metallic shell 20 includes a hexagonal portion 24 having a configuration suitable for receiving a socket wrench. A lower threaded portion 26 is formed around the ceramic insulator 22 for attachment of the spark plug 10 to a cylinder block of the internal combustion engine.

The ceramic insulator 22 has a cylindrically shaped bottom portion that converges into a rectangular shaped insulator tip 28 having radial ends extending outward from the metallic shell 20 from 0.10 inches (2.54 mm) to 0.20 inches (5.08 mm), as illustrated in FIGS. 1 and 3. The primary purpose of the ceramic insulator 22 is to provide mechanical support for a central electrode 30 and to insulate it from a high voltage.

The secondary purpose of the ceramic insulator 22, particularly in modern engines with deeply recessed plugs, is to extend the spark plug 10 above the engine's cylinder head so as to make the spark plug more accessible including its terminal 32 which is attached to the top of the central electrode 30. Ribs 34 are provided in an exposed top portion to provide electrical isolation and prevent electrical energy from leaking along the insulator surface from the terminal 32 to the metallic shell 20.

The central electrode 30 is surrounded by the ceramic insulator 22 within the metallic shell 20. The electrode 30 is terminated with a firing tip 36 extending from insulator tip 28 of the ceramic insulator 22. The central electrode 30 is offset, as illustrated in FIGS. 1 and 3, and continues parallel away from the centerline of the spark plug 10 in an opposed direction from other electrodes. The central electrode 30 has a reduced diameter on the firing tip 36, with a reduced diameter ranging from 0.09 inches (2.29 mm) to 0.10 inches (2.54 mm) when leaving the insulator tip 28. The reduced diameter of the central electrode 30 permits the electrons to be emitted where the electrical field strength is greatest, particularly where the surface is the smallest and a sharp edge is provided.

A neutral electrode 38, as shown best in FIGS. 1 and 3, extends from the insulator tip 28 of the ceramic insulator 22, permitting a first spark gap $\#\mathbf{1}^{GAP}$ at a distance separated from the central electrode 30, with the distance of at least 0.015 inches (0.38 mm). The neutral electrode 38 extends from the insulator tip 28 of the ceramic insulator 22 and is imbedded into the insulator tip 28 by at least double its overall length. The extended end of the neutral electrode 38 has a length, as designated by the alpha numeral "A" in FIG. 3, from 0.09 inches (2.29 mm) to 0.10 inches (2.54 mm), a diameter of essentially 0.04 inches (1.00 mm), and is bent at an angle towards the central electrode 30 from 10 degrees to 15 degrees. The neutral electrode 38 and the central electrode 30 extend essentially the same distance from the insulator tip 28 of the ceramic insulator.

A side ground electrode 40 is attached to the metallic shell 20, and is laterally aligned with the central electrode 30 and the neutral electrode 38, as illustrated best in FIG. 2. The ground electrode 40 creates a second spark gap $\#\mathbf{2}^{GAP}$ at a distance separated from the neutral electrode 38. The second spark gap $\#\mathbf{2}^{GAP}$ is defined as at least 0.150 inches (0.30 mm). The side ground electrode 40 is configured in a dogleg shape, with a knee portion 42 adjacent to the insulator tip 28. The ground electrode 40 has a width ranging from 0.012 inches (0.30 mm) to 0.15 inches (3.8 mm) and is attached to the metallic shell 20 with a weld bead 44 surrounding the entire electrode, as depicted in FIG. 2. The weld bead 44 may be either welded by a conventional welding process or hot forged.

A third spark gap $\#\mathbf{3}^{GAP}$ is formed from the ground electrode 40, as illustrated in FIG. 3, and is defined as a distance between the insulator tip 28 and the ground electrode of no less than 0.006 inches (0.15 mm)

The spark plug metallic shell 20 and ground electrode 40 is preferably plated with chromium, however other materials of plating, such as nickel, may be used for corrosion protection.

While the invention has been described in detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A neutral electrode spark plug for an internal combustion engine comprising:

a) a cylindrical metallic shell having a tubular ceramic insulator with an insulator tip enclosed therein, wherein said tubular ceramic insulator has a cylindrical shaped bottom portion that converges into said insulator tip having a rectangular shape with radial ends that extends from said metallic shell from 0.10 inches (2.54 mm) to 0.20 inches (5.08 mm), b) a central electrode surrounded by the ceramic insulator within the metallic shell with the central electrode having a firing tip extending from the insulator tip of the ceramic insulator, c) a neutral electrode extending from the insulator tip of the ceramic insulator, the neutral, electrode having a first spark gap separated from the central electrode, and d) a side ground electrode attached to the metallic shell, laterally aligned with the central electrode and the neutral electrode, with the ground electrode having a second spark gap separated from the neutral electrode, and a third spark gap separated away from the insulator tip.

2. The neutral electrode spark plug for an internal combustion engine as recited in claim 1 wherein said metallic shell further comprises a hexagonal portion having a configuration suitable for receiving a wrench socket, and a lower threaded portion formed around said ceramic insulator for attachment of said spark plug to a cylinder block of the internal combustion engine.

3. The neutral electrode spark plug for an internal combustion engine as recited in claim 1 wherein said central electrode is offset at said ceramic insulator bottom portion and continues parallel from an imaginary centerline of said spark plug in an opposed direction away from said neutral electrode and said ground electrode.

4. The neutral electrode spark plug for an internal combustion engine as recited in claim 1 wherein said central electrode has an external end diameter ranging from 0.09 inches (2.29 mm) to 0.10 inches (2.54 mm) from said insulator tip.

5. The neutral electrode spark plug for an internal combustion engine as recited in claim 1 wherein said neutral electrode extending from said insulator tip of said ceramic insulator is imbedded into said insulator tip at least double said portion of said neutral electrode's overall length.

6. The neutral electrode spark plug for an internal combustion engine as recited in claim 5 wherein said extending end of said neutral electrode from having a length ranging from 0.09 inches (2.29 mm) to 0.10 inches (2.54 mm).

7. The neutral electrode spark plug for an internal combustion engine as recited in claim 1 wherein said neutral electrode extending from the bottom portion of said insulator tip is bent at an angle towards said central electrode from 10 degrees to 15 degrees.

8. The neutral electrode spark plug for an internal combustion engine as recited in claim 1 wherein said first spark gap is defined as a distance between said neutral electrode and said central electrode of at least 0.015 inches (0.38 mm).

9. The neutral electrode spark plug for an internal combustion engine as recited in claim 1 wherein said neutral electrode and said central electrode extend essentially the same distance from said insulator tip.

10. The neutral electrode spark plug for an internal combustion engine as recited in claim 1 wherein said second spark gap is defined as a distance between said neutral electrode and said ground electrode of at least 0.012 inches (0.30 mm).

11. The neutral electrode spark plug for an internal combustion engine as recited in claim 1 wherein said third gap is defined as a distance between said insulator tip and said ground electrode of at least 0.006 inches (0.15 mm).

12. The neutral electrode spark plug for an internal combustion engine as recited in claim 1 wherein said side ground electrode is configured in a dogleg shape, with a knee portion adjacent to said insulator tip.

13. The neutral electrode spark plug for an internal combustion engine as recited in claim 1 wherein said ground electrode is attached to said metallic shell of said spark plug.

14. The neutral electrode spark plug for an internal combustion engine as recited in claim 13 wherein said ground electrode is attached to said metallic shell with a weld bead that surrounds said ground electrode.

15. The neutral electrode spark plug for an internal combustion engine as recited in claim 1 wherein said ground electrode has a width ranging from 0.012 inches (0.30 mm) to 0.15 inches (3.8 mm).

16. The neutral electrode spark plug for an internal combustion engine as recited in claim 1 wherein said spark plug metallic shell and said ground electrode are plated with chromium.

* * * * *